US010285253B2

(12) United States Patent
Teramoto et al.

(10) Patent No.: US 10,285,253 B2
(45) Date of Patent: May 7, 2019

(54) DISCHARGE ELECTRODES AND LIGHT SOURCE DEVICE

(71) Applicant: USHIO DENKI KABUSHIKI KAISHA, Tokyo (JP)

(72) Inventors: Yusuke Teramoto, Tokyo (JP); Akihisa Nagano, Tokyo (JP); Hideyuki Urakami, Tokyo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/564,328

(22) PCT Filed: Apr. 1, 2016

(86) PCT No.: PCT/JP2016/001884
§ 371 (c)(1),
(2) Date: Oct. 4, 2017

(87) PCT Pub. No.: WO2016/163108
PCT Pub. Date: Oct. 13, 2016

(65) Prior Publication Data

US 2018/0139830 A1 May 17, 2018

(30) Foreign Application Priority Data

Apr. 7, 2015 (JP) ..... 2015-078411

(51) Int. Cl.
*H05G 2/00* (2006.01)
*H05H 1/46* (2006.01)

(52) U.S. Cl.
CPC ..... *H05G 2/003* (2013.01); *H05G 2/00* (2013.01); *H05G 2/008* (2013.01); *H05H 1/46* (2013.01); *H05H 2001/466* (2013.01)

(58) Field of Classification Search
CPC ..... H05G 2/005; H05G 2/003; H05G 2/008; H05G 2/006; G03F 7/70033;
(Continued)

(56) References Cited

U.S. PATENT DOCUMENTS 7,427,766 B2 9/2008 Jonkers et al.
7,501,642 B2 * 3/2009 Moors ..... G03F 7/70033 250/492.1
(Continued)

FOREIGN PATENT DOCUMENTS

JP 2007-012603 A 1/2007
JP 2007-505460 A 3/2007
(Continued)

OTHER PUBLICATIONS

International Search Report issued in PCT/JP2016/001884; dated Jun. 16, 2016.

*Primary Examiner* — David A Vanore
(74) *Attorney, Agent, or Firm* — Studebaker & Bracktt PC

(57) ABSTRACT

An extreme ultraviolet light source device includes a pair of disk-shaped discharge electrodes which face each other with their peripheral portions being spaced from each other, a pulsed power supply unit for supplying pulsed power to the discharge electrodes, a raw material supply unit for supplying onto the discharge electrodes raw materials that emit extreme ultraviolet light, and an energy beam irradiation unit for irradiating the raw materials on curved surfaces of the discharge electrodes with an energy beam to vaporize the raw materials. At least one of the paired discharge electrodes has a tapered surface at a peripheral portion of at least one of two circular surfaces thereof. The tapered surface inclines radially outward such that the thickness of the discharge electrode decreases in the radially outward direction.

20 Claims, 6 Drawing Sheets

(58) Field of Classification Search
CPC ..... G03F 7/70916; G03F 7/70166; G03F 7/70175; G03F 7/70191; G03F 7/70575
USPC ... 250/504 R, 493.1, 492.1, 503.1, 365, 372, 250/423 R, 425, 492.21; 315/111.21; 378/119, 134, 135, 136, 144
See application file for complete search history.

(56) References Cited

U.S. PATENT DOCUMENTS 7,622,727 B2 * 11/2009 Shirai ..... B82Y 10/00 250/423 R
7,626,188 B2 * 12/2009 Shirai ..... H05G 2/005 250/504 R
7,759,663 B1 * 7/2010 Van Herpen ..... B82Y 10/00 250/492.1
8,227,779 B2 * 7/2012 Neff ..... H05G 2/005 250/504 R
8,253,123 B2 * 8/2012 Jonkers ..... H05G 2/005 250/365
8,416,391 B2 * 4/2013 Banine ..... H05G 2/005 250/493.1
8,519,368 B2 * 8/2013 Neff ..... H05G 2/005 250/372
9,119,279 B2 * 8/2015 Pawlowski ..... H05G 2/008
9,411,238 B2 * 8/2016 Yakunin ..... G03F 7/70033
9,433,068 B2 * 8/2016 Shirai ..... H05G 2/005
9,480,136 B2 * 10/2016 Teramoto ..... H05G 2/005
2007/0040511 A1 * 2/2007 Ziener ..... H05G 2/003 315/111.21
2007/0085044 A1 * 4/2007 Hergenhan ..... H05G 2/003 250/504 R
2007/0090304 A1 * 4/2007 Jonkers ..... H05G 2/003 250/504 R
2011/0133641 A1 * 6/2011 Zhokhavets ..... H05G 2/003 313/631

FOREIGN PATENT DOCUMENTS

JP 2010-512020 A 4/2010
JP 2011-508377 A 3/2011

* cited by examiner

DISCHARGE ELECTRODES AND LIGHT SOURCE DEVICE

TECHNICAL FIELD

The present invention relates to discharge electrodes for use in a light source device configured to emit light upon electric discharging, and also relates to a light source device having such discharge electrodes.

BACKGROUND ART

In recent years, a light source for exposure needs to emit light at a short(er) wavelength as a semiconductor integrated circuit is designed more compact and circuit integration has a higher density. As a next-generation light source for exposing a semiconductor, developed is an extreme ultraviolet (hereinafter, occasionally referred to as "EUV") light source device that emits extreme ultraviolet light at a wavelength of, particularly, 13.5 nm.

Several methods are known to cause the EUV light source device to emit EUV light. One of such methods heats and excites an extreme ultraviolet emission seed (EUV emission seed) to generate high temperature plasma, and extracts EUV light from the high temperature plasma.

An EUV light source device that employs such method is categorized into an LPP (Laser Produced Plasma) type and a DPP (Discharge Produced Plasma) type, depending upon a method used to generate high temperature plasma.

A DPP type EUV light source device applies a high voltage across a pair of electrodes, which is supplied with a discharge gas containing an extreme ultraviolet light emission seed, to generate high-density and high-temperature plasma upon electric discharging, and uses extreme ultraviolet light emitted therefrom. For use with the DPP type EUV light source device, a method has been proposed that includes supplying a surface of each electrode, which is used to generate electric discharge, with a raw material such as Sn (tin) or Li (lithium), and irradiating the raw material with an energy beam such as a laser beam for evaporation thereof such that high-temperature plasma is generated upon electric discharging. Such method is sometimes referred to as an LDP (Laser Assisted Discharge Produced Plasma) method or an LDP type. An LDP type EUV light source device is disclosed in, for example, Patent Literature Document 1. In Patent Literature Document 1 (Japanese Patent Application Laid-Open Publication No. 2007-505460), a pair of disk-shaped rotating electrodes are used as the above-mentioned electrodes, and the paired rotating electrodes are disposed such that the peripheral edges of the two rotating electrodes face each other.

LISTING OF REFERENCES

Patent Literature Documents

Patent Literature Document 1: Japanese Patent Application Laid-Open Publication No. 2007-505460

SUMMARY OF THE INVENTION

Problems to be Solved by the Invention

The output efficiency of the EUV light varies with the shape(s) of the electrode(s). Patent Literature Document 1 (Japanese Patent Application Laid-Open Publication No. 2007-505460), however, does not consider the shapes of the electrodes at all, for the purpose of obtaining desired EUV output. When the EUV light, which is emitted from plasma generated between the electrodes, is extracted from the electrodes, the electrodes having certain shapes block part of the EUV light by the end portion(s) of the electrode(s), and therefore the extraction angle of the EUV light may not become a desired angle. When the energy beam is directed to the raw material on the electrodes, the incident angle of the energy beam may be restricted depending upon the shapes of the electrodes, and therefore it may be impossible to direct the energy beam at a desired angle (the electrodes may not be irradiated with the energy beam at a desired angle).

The technology disclosed in Patent Literature Document 1, therefore, may not be able to achieve a desired extraction efficiency of the EUV light and may not be able to generate desired plasma.

Accordingly, an object of the present invention is to provide discharge electrodes, each of which has a shape that can provide a desired light output, and to provide a light source device equipped with such discharge electrodes.

Solution to the Problems

In order to achieve the above-mentioned object, one aspect of the present invention provides discharge electrodes for use in a light source device. The light source device includes a pair of disc-shaped discharge electrodes disposed such that peripheries thereof oppose each other with a predetermined space left therebetween, a pulsed power supply unit that supplies pulsed power across the discharge electrodes, a raw material (source material) supply unit that supplies onto the discharge electrodes a source material to emit light, and an energy beam irradiation unit that irradiates the source material on curved surfaces of the discharge electrodes with an energy beam to vaporize the source material. At least one of the paired discharge electrodes has an inclined surface formed on a periphery of at least one of two circular surfaces thereof. The inclined surface inclines such that a thickness of the discharge electrode concerned decreases in a radially outward direction of the discharge electrode.

With this configuration, when the inclined surface is formed, for example, on the circular surface on the light extraction side, then it is possible to avoid or reduce the possibility that the light emitted from the plasma be blocked by the end of the electrode, and possible to have a large light extraction angle. When the inclined surface is formed on the circular surface on the energy beam incident side, then it is possible for the energy beam to have a large incident angle to the discharge electrode, and enhance the energy beam intensity per unit area on the discharge electrode. The incident angle of the energy beam is an angle between the energy beam incident plane and the energy beam incident direction (angle $\gamma$ in FIG. 3). As such, the discharge electrode can have a shape that provides a desired light output. Because the inclined surface(s) may easily be obtained by cutting, grinding, machining or the like, a complicated manufacturing process is not needed to obtain a desired light output.

The inclined surface of the discharge electrode may have an angle of inclination corresponding to a take-off angle (extraction angle) of the light from the discharge electrodes, and may be provided on the periphery of the circular surface located on a side toward which the light is extracted from the discharge electrodes. With such configuration, it is possible to extract the light from the discharge electrodes at a desired extraction angle. Thus, it is possible to achieve a desired light extraction efficiency.

The inclined surface of the discharge electrode may have an angle of inclination corresponding to an angle of incidence of the energy beam on the curved surface of the discharge electrode, and may be provided on the periphery of the circular surface located on a side where a radiation source of the energy beam is installed. With such configuration, it is possible to cause the energy beam to be incident to the discharge electrodes at a desired angle of incidence. Thus, it is possible to generate desired plasma, and generate stable light.

The angle of inclination of the inclined surface provided on one of the two circular surfaces of the discharge electrode may be set to an angle different from the angle of inclination of the inclined surface provided on the opposite circular surface of the same discharge electrode. When the inclination angles of the inclined surfaces of the opposite circular surfaces of the discharge electrode are different from each other, it is possible to increase a degree of freedom in setting the light extraction angle and the angle of incidence of the energy beam.

The angle of inclination of the inclined surface provided on one of the two discharge electrodes may be set to an angle different from the angle of inclination of the inclined surface provided on the other of the two discharge electrodes. When the inclination angles of the inclined surfaces of the two discharge electrodes are different from each other, it is possible to have the inclined surface(s) only at a necessary position or positions. Thus, it is possible to omit unnecessary machining steps.

According to another aspect of the present invention, there is provided a light source device including any one of the above-described discharge electrodes. This light source device is able to provide a desired light output.

The light of the light source device may be extreme ultraviolet light, an X-ray, or vacuum ultraviolet light.

Advantageous Effects of the Invention

The present invention can have a desired take-off angle (extraction angle) of the light emitted from the plasma, which is generated upon electric discharging across the electrodes, and can generate desired plasma. Thus, the present invention can provide a desired light output.

These and other objects, aspects and advantages of the present invention will be understood by a person skilled in the art from the following detailed description of the present invention with reference to the accompanying drawings and the claims.

DESCRIPTION OF EMBODIMENTS

Hereinafter, embodiments of the present invention will be described with reference to the drawings.

First Embodiment

Figure 1:
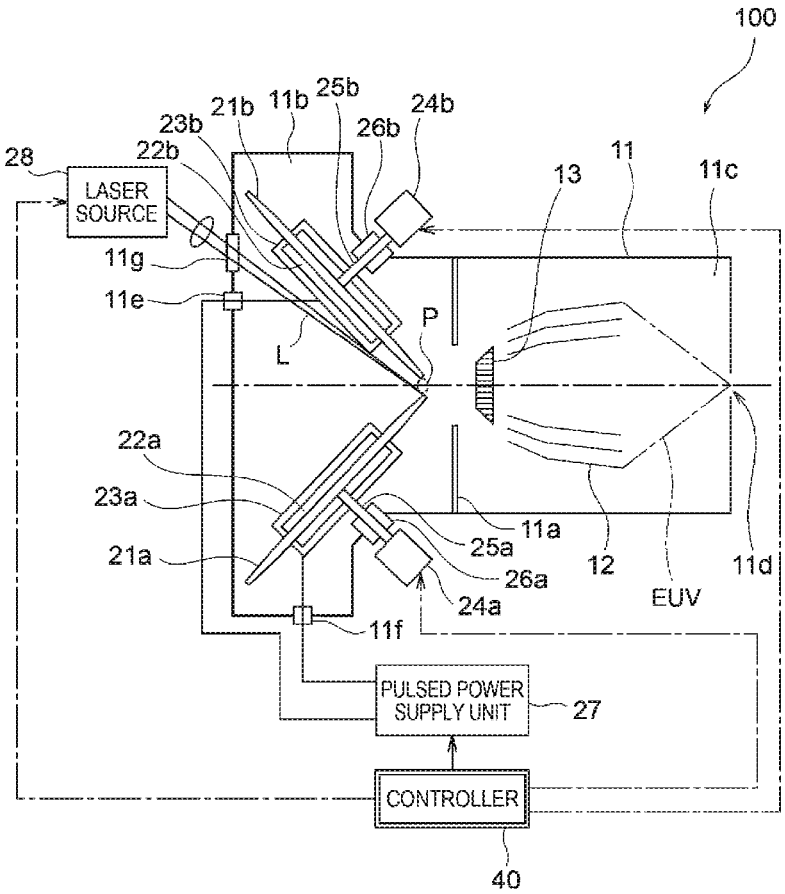
FIG. 1 schematically shows a structure of an exemplary extreme ultraviolet light source device according to one embodiment of the present invention.

FIG. 1 is a schematic configuration diagram illustrating a light source device according to the present embodiment. The present embodiment deals with an example in which the light source device is an extreme ultraviolet light source device (EUV light source device).

An EUV light source device 100 is an apparatus that can be used as a light source for exposing semiconductor and emits extreme ultraviolet light (EUV light) at a wavelength of 13.5 nm, for example.

The EUV light source device 100 according to the present embodiment is a DPP type EUV light source device and is more specifically an LDP type EUV light source device. An LDP type EUV light source device irradiates a high-temperature-plasma source material supplied to a surface of an electrode for producing a discharge with an energy beam, such as a laser beam, to vaporize the high-temperature-plasma source material and then produces high-temperature plasma upon electric discharging.

In this light source device, vacuum ultraviolet light (10 nm to 200 nm) or X-rays (soft X-rays to hard X-rays: 10 pm to 10 nm) can also be extracted by selecting an appropriate high-temperature-plasma source material and adjusting the conditions for exciting the high-temperature-plasma source material.

As illustrated in FIG. 1, the EUV light source device 100 includes a chamber 11 serving as a vessel of discharge. The chamber 11 is roughly divided into two spaces by a partition wall 11*a* having an opening. One of the two spaces is a discharge space 11*b*, and the other space is a light condensing space (light collecting space) 11*c*.

Two discharge electrodes 21*a* and 21*b*, which are each independently rotatable, are disposed to oppose each other with a space provided therebetween in the discharge space 11*b*. The discharge electrodes 21*a* and 21*b* are discharge members for heating and exciting a high-temperature-plasma source material including an EUV radiation seed.

The pressure inside the discharge space 11*b* is kept to a vacuum atmosphere so that the discharge for heating and exciting the high-temperature-plasma source material occurs favorably.

An EUV collector mirror (collector mirror) 12 and a debris trap 13 are disposed in the light condensing space 11*c*.

The EUV collector mirror 12 collects EUV light, which is radiated upon heating and exciting the high-temperature-plasma source material, and guides the EUV light, for example, to an irradiation optical system (not illustrated) of an exposure device via an EUV outlet 11*d* provided in the chamber 11.

The EUV collector mirror 12 is, for example, an oblique-incidence collector mirror and has a structure in which a plurality of thin concave mirrors are arranged precisely in a nested pattern. The reflective surface of each concave mirror has, for example, a shape of an ellipsoid of revolution, a shape of a paraboloid of revolution, or a Wolter shape, and each concave mirror has a shape of a body of revolution. The Wolter shape is a concave shape in which a light-incident surface is composed of a hyperboloid of revolution and an ellipsoid of revolution or composed of an ellipsoid of revolution and a hyperboloid of revolution arranged successively from the light-incoming side.

The EUV collector mirror 12 includes a plurality of concave mirrors that each have a reflective surface in the shape of an ellipsoid of revolution, the Wolter shape, or the like and that are in the shapes of bodies of revolution having different diameters. The concave mirrors of the EUV collector mirror are disposed coaxially with their axes of revolution aligned with each other so that their focal points substantially coincide with each other. As these concave mirrors are arranged precisely in a nested pattern in this manner, the EUV collector mirror 12 can favorably reflect EUV light incident obliquely thereon at approximately 25° or less and collect (condense) the EUV light at a single point.

The base material of each concave mirror is, for example, nickel (Ni) or the like. In order to reflect EUV light having a very short wavelength, the reflective surface of each concave mirror is formed into a highly smooth surface. The reflective material provided on this smooth surface is a metal film of, for example, ruthenium (Ru), molybdenum (Mo), rhodium (Rh), or the like. The reflective surface of each concave mirror is coated precisely with such metal film.

The debris trap 13 traps debris, which are generated as plasma is produced upon electric discharging, and prevents or suppresses the movement of debris into the EUV light collecting area. The debris trap 13 plays a role of trapping debris and allowing only the EUV light to pass therethrough.

The discharge electrodes 21*a* and 21*b* disposed in the discharge space 11*b* are disc-shaped members and are made of metal. The discharge electrodes 21*a* and 21*b* are made, for example, of a high-melting-point metal, such as tungsten, molybdenum, or tantalum. Of the two discharge electrodes 21*a* and 21*b*, one discharge electrode 21*a* is a cathode, and the other discharge electrode 21*b* is an anode.

The discharge electrode 21*a* is disposed such that a portion thereof is immersed in a high-temperature-plasma source material 22*a* received in a container 23*a*. A rotating shaft 25*a* of a motor 24*a* is mounted to the substantially center portion of the discharge electrode 21*a*. Specifically, the discharge electrode 21*a* rotates as the motor 24*a* causes the rotating shaft 25*a* to rotate. The driving of the motor 24*a* is controlled by a control unit 40.

The rotating shaft 25*a* extends into the chamber 11 via a mechanical seal 26*a*, for example. The mechanical seal 26*a* keeps the inside of the chamber 11 to a reduced-pressure atmosphere while allowing the rotating shaft 25*a* to rotate.

Similar to the discharge electrode 21*a*, the discharge electrode 21*b* is disposed such that a portion thereof is immersed in a high-temperature-plasma source material 22*b* received in a container 23*b*. A rotating shaft 25*b* of a motor 24*b* is mounted to the substantially center portion of the discharge electrode 21*b*. Specifically, the discharge electrode 21*b* rotates as the motor 24*b* causes the rotating shaft 25*b* to rotate. The driving of the motor 24*b* is controlled by the control unit 40.

The rotating shaft 25*b* extends into the chamber 11 via a mechanical seal 26*b*, for example. The mechanical seal 26*b* keeps the inside of the chamber 11 to a reduced-pressure atmosphere while allowing the rotating shaft 25*b* to rotate.

The liquid high-temperature-plasma source materials 22*a* and 22*b* on the surfaces of the discharge electrodes 21*a* and 21*b* are transported to a discharge region as the discharge electrodes 21*a* and 21*b* rotate.

The discharge region is a space between the electrodes 21*a* and 21*b* in which an electric discharge takes place and is an area across which the electrodes 21*a* and 21*b* are closest to each other. In the present embodiment, the discharge electrodes 21*a* and 21*b* are disposed to oppose each other such that their edge portions on the peripheries are spaced apart from each other by a predetermined distance. Therefore, the discharge region is an area across which the distance between the edge portions on the peripheries of the electrodes 21*a* and 21*b* is shortest.

A molten metal, such as liquid tin (Sn), is used as the high-temperature-plasma source materials 22*a* and 22*b*. The high-temperature-plasma source materials 22*a* and 22*b* also function as power supplying conductors for supplying power to the discharge electrodes 21*a* and 21*b*.

The containers 23*a* and 23*b* are connected to a pulsed power supply unit 27 via power introducing units 11*e* and 11*f* that can keep the inside of the chamber 11 to a reduced-pressure atmosphere. The power introducing units 11*e* and 11*f* are made from an insulating material. The containers 23*a* and 23*b* and the high-temperature-plasma source materials 22*a* and 22*b*, i.e., tin, are conductive. The discharge electrode 21*a* is partially immersed in the tin 22*a*, and the discharge electrode 21*b* is partially immersed in the tin 22*b*. Therefore, pulsed power can be supplied across the discharge electrodes 21*a* and 21*b* by supplying pulsed power across the containers 23*a* and 23*b* from the pulsed power supply unit 27.

Although not illustrated, temperature adjusting mechanisms for keeping the tin 22*a* and 22*b* in a molten state are provided in the containers 23*a* and 23*b*.

The pulsed power supply unit 27 supplies pulsed power having a short pulse duration across the containers 23*a* and 23*b*, or in other words, across the discharge electrodes 21*a* and 21*b*. The driving of the pulsed power supply unit 27 is controlled by the control unit 40.

A laser source 28 is an energy beam irradiation unit that irradiates the tin 22*a* on the discharge electrode 21*a*, which is transported to the discharge region, with a laser beam (energy beam). The laser source 28 is, for example, an Nd:$YVO_4$ laser device (Neodymium-doped Yttrium Orthovanadate laser device). A laser beam L emitted from the laser source 28 is incident on a window portion 11*g* of the chamber 11 via a laser beam condensing unit and so on and is guided onto the discharge electrode 21*a*. The irradiation timing of the laser beam from the laser source 28 is controlled by the control unit 40.

When the high-temperature-plasma source material 22*a* transported to the discharge region is irradiated with a laser beam while pulsed power is being supplied to the discharge electrodes 21*a* and 21*b* by the pulsed power supply unit 27, the high-temperature-plasma source material is vaporized, and a pulsed discharge starts across the electrodes 21*a* and 21*b*. Consequently, plasma P of the high-temperature-plasma source materials 22*a* and 22*b* is formed. Then, when the plasma P is heated and excited by a large current that flows during the electric discharge and is brought to a high temperature, EUV light is radiated from this high-temperature plasma P.

As described above, since the pulsed power supply unit 27 supplies pulsed power across the discharge electrodes 21*a* and 21*b*, the electric discharge is a pulsed discharge, and the EUV light to be radiated is pulsed light.

In the present embodiment, in order to obtain a desired EUV light output, inclined surfaces (tapered surfaces) are formed at the peripheries of the circular surfaces of the discharge electrodes 21*a* and 21*b*, and each of the inclined surfaces inclines such that the thickness of the disc decreases in the radially outward direction of the disc. Hereinafter, the shape of the discharge electrodes 21*a* and 21*b* will be described more specifically.

Figure 2:
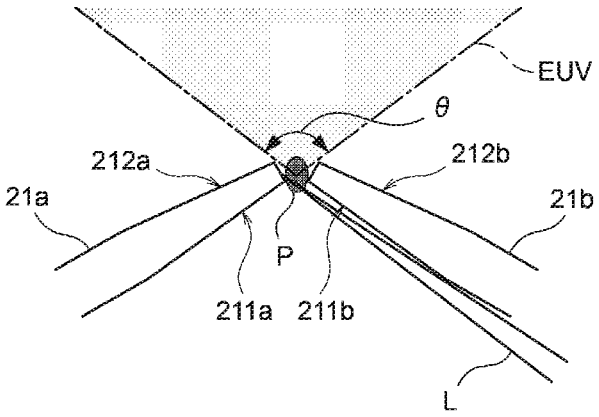
FIG. 2 shows shapes of discharge electrodes.

FIG. 2 illustrates the shape of the discharge electrode 21*a* and the shape of the discharge electrode 21*b*.

The discharge electrode 21*a* includes an inclined surface 211*a* on the incoming side of the laser beam L and an inclined surface 212*a* on the radiation side of the EUV light. In this specification, the incoming side of the laser beam L is the side from which the laser beam L impinging the curved surface of the cathode (the discharge electrode 21*a*) is coming and is the side where the laser source 28 serving as an emission source of the laser beam L is installed. The radiation side of the EUV light is the side toward which the EUV light is radiated (extracted) from the discharge electrodes 21*a* and 21*b*. The discharge electrode 21*b* includes an inclined surface 211*b* on the incoming side and an inclined surface 212*b* on the radiation side. In the example illustrated in FIG. 2, the discharge electrode 21*a* and the discharge electrode 21*b* have an identical shape.

Figure 3:
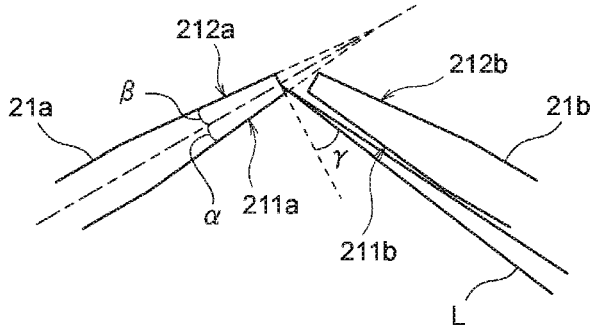
FIG. 3 is a view useful to describe an angle of inclination of an inclined surface and an angle of incident of a laser beam.

The angles of inclination of the inclined surfaces 211*a* and 211*b* on the incoming side are determined such that the angle of incidence of the laser beam L on the discharge electrode 21*a* becomes a desired angle. The angles of inclination of the inclined surfaces 212*a* and 212*b* on the radiation side are determined such that the angle θ of radiation of the EUV light (take-off angle, or an extraction angle) becomes a desired angle. The angle of inclination of the inclined surface 211*a* on the incoming side is an angle α indicated in FIG. 3, and the angle of inclination of the inclined surface 212*a* on the radiation side is an angle β indicated in FIG. 3. The same applies to the inclined surfaces 211*b* and 212*b*. The angle of incidence of the laser beam L is an angle γ indicated in FIG. 3.

The angle of inclination of the inclined surfaces 211*a* and 211*b* on the incoming side and the angle of inclination of the inclined surfaces 212*a* and 212*b* on the radiation side may be the same ($\alpha=\beta$) or may be different ($\alpha\neq\beta$).

Figure 9:
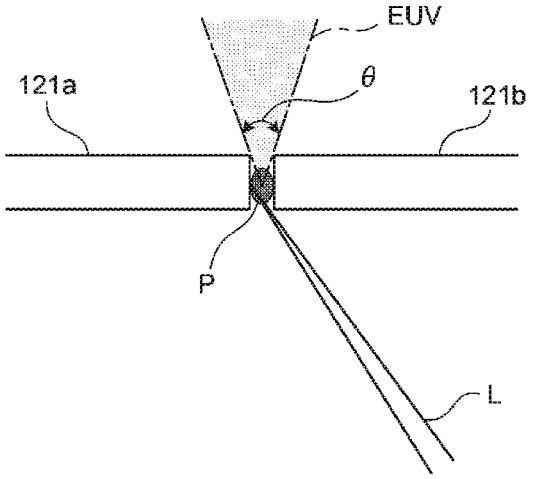
FIG. 9 shows an example when the discharge electrodes are arranged in a single plane.

FIG. 9 illustrates an example in which disc-shaped discharge electrodes 121*a* and 121*b* are disposed substantially coplanarly. The discharge electrodes 121*a* and 121*b* illustrated in FIG. 9 do not have inclined surfaces, unlike the discharge electrodes 21*a* and 21*b* according to the present embodiment. With such configuration, some of the EUV light radiated from the plasma P, which is produced upon the electric discharge across the electrodes, is more likely to be blocked by the ends of the discharge electrodes 121*a* and 121*b* on the radiation side (the ends on the upper side in FIG. 9). Therefore, the angle of radiation of the EUV is reduced accordingly, and the extraction efficiency of the EUV light drops.

As described above, the electric discharge is likely to occur at a location where the two electrodes are closest to each other. In the case of the arrangement illustrated in FIG. 9, the axis of rotation of the discharge electrode 121*a* is parallel to the axis of rotation of the discharge electrode 121*b*, and thus the anode and the cathode are disposed such that their end faces oppose each other. Therefore, the region where an electric discharge can occur is linear in the case of the arrangement illustrated in FIG. 9. In other words, the electric discharge occurs at an arbitrary location in the linear region, and the location where the electric discharge occurs is unstable. Therefore, the EUV light output is unstable.

Figure 10:
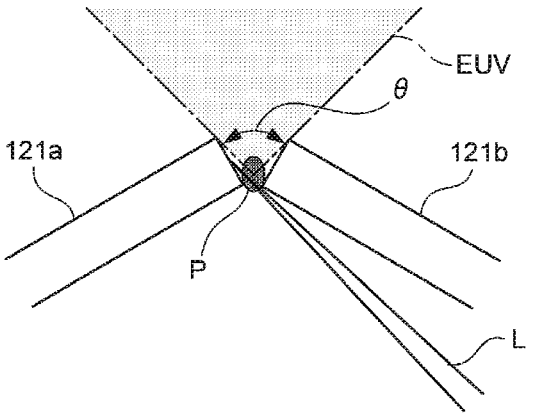
FIG. 10 shows an example when the discharge electrodes having no inclined surfaces are disposed such that their peripheries face each other.

FIG. 10 illustrates an example in which the discharge electrodes 121*a* and 121*b* illustrated in FIG. 9 are disposed such that their axes of rotation intersect at a predetermined angle. Here, the discharge electrodes 121*a* and 121*b* are disposed with their edge portions opposing each other such that the distance between the end faces on the radiation side of the EUV light (the upper side in FIG. 10) is greater than the distance between the end faces on the incoming side of the laser beam L (the lower side in FIG. 10). With this arrangement, as compared to the example illustrated in FIG. 9, a smaller amount of EUV light radiated from the plasma P is blocked by the ends of the electrodes on the radiation side, and a larger amount of EUV light can be extracted. In other words, the extraction efficiency of the EUV light from the plasma P can be improved.

In the case of the arrangement illustrated in FIG. 10, the anode and the cathode are disposed such that their edge portions on the peripheries oppose each other. Therefore, in this case, the region where an electric discharge can occur lies on one point on each edge portion. In other words, an electric discharge occurs across predetermined point regions on the two electrodes. In this manner, the location where the electric discharge occurs stabilizes, and the EUV light output stabilizes as a result.

However, in the arrangement illustrated in FIG. 10, the angle of incidence of the laser beam L on the cathode (discharge electrode 121*a*) needs to be reduced, as compared to the arrangement illustrated in FIG. 9, so that the laser beam L impinging the cathode (discharge electrode 121*a*) is not blocked by the end of the anode (discharge electrode 121*b*) on the incoming side (the end on the lower side in FIG. 10). In other words, the irradiation region of the laser beam L on the discharge electrode 121*a* is greater in the arrangement illustrated in FIG. 10 than in the arrangement illustrated in FIG. 9.

Figure 11A:
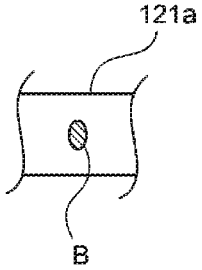
FIG. 11A is a view that shows a shape of a beam on the electrode of FIG. 9.
Figure 11B:
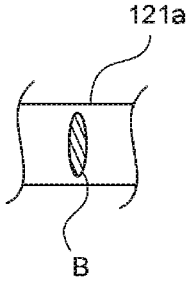
FIG. 11B is a view that shows a shape of a beam on the electrode of FIG. 10.

In the case of the arrangement illustrated in FIG. 9, a beam shape B on the discharge electrode 121*a* has an elliptical shape that is close to a circle, as illustrated in FIG. 11A. In contrast, in the case of the arrangement illustrated in FIG. 10, a beam shape B on the discharge electrode 121*a* has an elliptical shape that is more elongated in the major axis direction, as illustrated in FIG. 11B. Therefore, the intensity of the laser beam per unit area is smaller in the arrangement illustrated in FIG. 10. Thus, the amount of vaporization of the high-temperature-plasma source material may become insufficient to prevent plasma from being produced, or the vaporized high-temperature-plasma source material may overly spread spatially to cause the plasma to spread too broadly. In this manner, a desired EUV light output may not be obtained.

In contrast, in the present embodiment, the inclined surfaces 211*a* and 211*b* are formed at the ends of the discharge electrodes 21*a* and 21*b* on the incoming side.

As the inclined surface 211*b* is formed on the anode (discharge electrode 21*b*) at the end on the incoming side, the angle γ of incidence of the laser beam L on the cathode (discharge electrode 21*a*) can be increased correspondingly. In other words, when the angles of the axes of rotation of the discharge electrodes 21*a* and 21*b* are the same as the angles of the axes of rotation of the discharge electrodes 121*a* and 121*b* illustrated in FIG. 10, the angle γ of incidence of the laser beam L can be increased, as compared to the configuration illustrated in FIG. 10.

Figure 4:
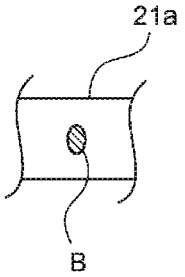
FIG. 4 is a view that shows a shape of a beam on the electrode.

Thus, in the present embodiment, as illustrated in FIG. 4, the beam shape B on the discharge electrode 21*a* can be made an elliptical shape that is close to a circle (an elliptical shape that is less elongated in the major axis direction). Therefore, the intensity of the laser beam per unit area can be increased, as compared to the configuration illustrated in FIG. 10. Thus, a sufficient amount of vaporization of the high-temperature-plasma source material can be ensured, and the plasma can be produced appropriately. In addition, the spatial spread of the vaporized high-temperature-plasma source material can be suppressed, and the plasma can be prevented from spreading too broadly.

The maximum value of the angle γ of incidence of the laser beam L with which the cathode (discharge electrode 21*a*) can be irradiated with the laser beam L, without the laser beam L being blocked by the anode (discharge electrode 21*b*) is determined by the angle of inclination (including the depth of inclination) of the inclined surface 211*b* formed on the anode (discharge electrode 21*b*). Therefore, by adjusting the angle of inclination of the inclined surface 211*b*, the angle γ of incidence of the laser beam L can be set to a desired angle.

By forming the inclined surface 211*a* on the cathode (discharge electrode 21*a*) at the end on the incoming side, which is similar to the anode (discharge electrode 21*b*), the edge portions on the ends of the electrodes can be disposed symmetrically. Therefore, the location where the electric discharge occurs can be stabilized. Thus, the fluctuation in the emission point of the EUV light can be suppressed, and a stable EUV light output can be obtained.

The inclined surfaces 212*a* and 212*b* are formed on the discharge electrodes 21*a* and 21*b* at their ends on the radiation side. Thus, when the angles of the axes of rotation of the discharge electrodes 21*a* and 21*b* are the same as the angles of the axes of rotation of the discharge electrodes 121*a* and 121*b* illustrated in FIG. 10, the amount of EUV radiation blocked by the ends of the electrodes on the radiation side is reduced, as compared to the configuration illustrated in FIG. 10. In other words, a larger amount of EUV light can be extracted, and the extraction efficiency of the EUV light from the plasma P can be improved.

The angle θ of EUV radiation is determined by the angles of inclination (including the depth of inclination) of the inclined surfaces 212*a* and 212*b* on the discharge electrodes 21*a* and 21*b* on the radiation side. Therefore, by adjusting the angles of inclination of the inclined surfaces 212*a* and 212*b*, the angle θ of EUV radiation can be set to a desired angle.

When the angle α of inclination of the inclined surface on the incoming side is equal to the angle β of inclination of the inclined surface on the radiation side, the inclination of a cutter for cutting the discharge electrodes 21*a* and 21*b* to form the inclined surfaces needs to be set only once. Therefore, the manufacture of the discharge electrodes 21*a* and 21*b* can be facilitated.

On the other hand, when the angle α of inclination of the inclined surface on the incoming side differs from the angle β of inclination of the inclined surface on the radiation side, the inclination of the cutter needs to be set twice. This makes the manufacturing process somewhat more complex as compared to the case in which the angles α and β are equal to each other. However, the case where the angle α is different from the angle β has an advantage in that the degree of freedom in setting the angle θ of EUV radiation and setting the angle γ of incidence of the laser beam L increases.

Modifications

In the above-described embodiment, the inclined surfaces are formed on the discharge electrodes 21*a* and 21*b* on both the incoming side and the radiation side. It should be noted, however, that an inclined surface may be formed on at least one of the discharge electrodes 21*a* and 21*b* on at least one of the incoming side and the radiation side.

Figure 5:
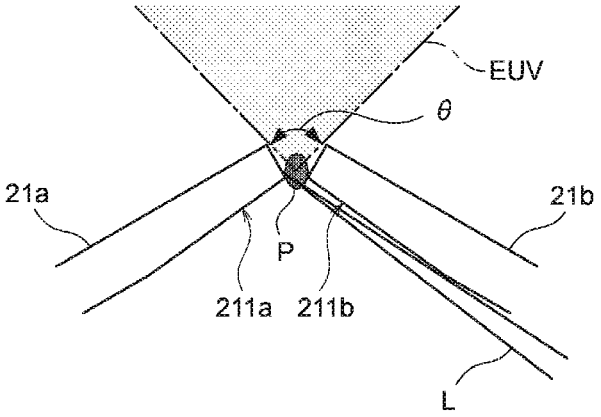
FIG. 5 shows another discharge electrodes having different shapes.

For example, as illustrated in FIG. 5, the inclined surfaces 211*a* and 211*b* may be formed on the discharge electrodes 21*a* and 21*b* only on the incoming side. In this case, although the angle θ of EUV radiation is the same as in the configuration illustrated in FIG. 10, the angle γ of incidence of the laser beam L on the cathode (discharge electrode 21*a*) can be increased, as compared to the configuration illustrated in FIG. 10. In this manner, as compared to the configuration illustrated in FIG. 10, the intensity of the laser beam per unit area on the discharge electrode 21*a* can be increased, and desired plasma P can be produced.

Figure 6:
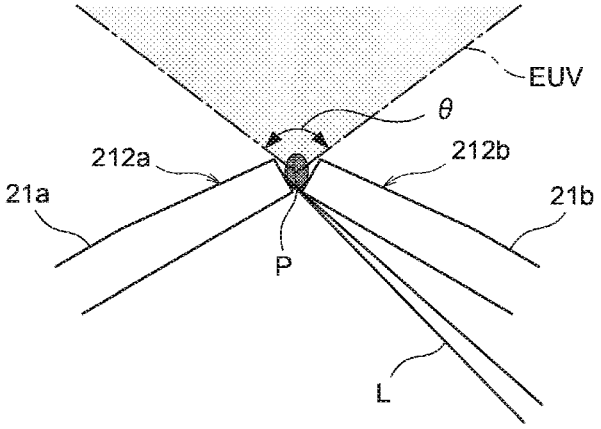
FIG. 6 shows still another discharge electrodes having different shapes.

Alternatively, as illustrated in FIG. 6, for example, the inclined surfaces 212*a* and 212*b* may be formed on the discharge electrodes 21*a* and 21*b* only on the radiation side. In this case, although the angle γ of incidence of the laser beam L on the cathode (discharge electrode 21*a*) is the same as in the configuration illustrated in FIG. 10, the angle θ of EUV radiation can be increased, as compared to the configuration illustrated in FIG. 10. In this manner, as compared to the configuration illustrated in FIG. 10, the extraction efficiency of the EUV light can be improved.

Figure 7:
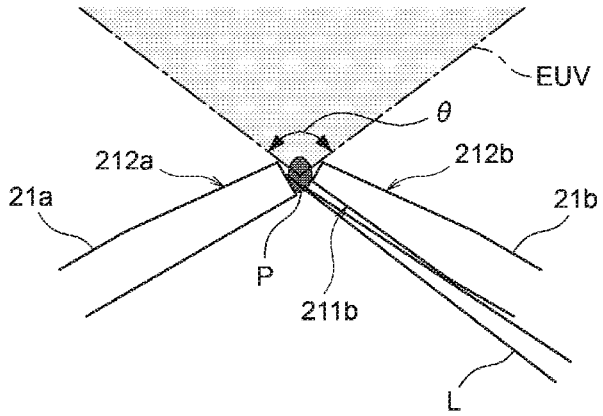
FIG. 7 shows yet another discharge electrodes having different shapes.

Alternatively, as illustrated in FIG. 7, for example, the inclined surface 211*b* may be formed only on the anode (discharge electrode 21*b*) on the incoming side. In this case, similar to the example illustrated in FIG. 5, the angle γ of incidence of the laser beam L on the cathode (discharge electrode 21*a*) can be increased, as compared to the configuration illustrated in FIG. 10. In addition, this renders a process such as cutting for forming the inclined surface on the discharge electrode 21*a* on the incoming side unnecessary, and thus the manufacturing process can be reduced accordingly. When the inclined surface is formed only on one of the two discharge electrodes on the incoming side, the anode and the cathode are disposed such that the edge portions on the ends of the electrodes are not symmetric. However, since this configuration is still different from FIG. 9, in which the end faces are disposed to oppose each other, the location where the electric discharge occurs can be fixed to a certain extent, and the location of the plasma P can be prevented from becoming unstable.

Figure 8:
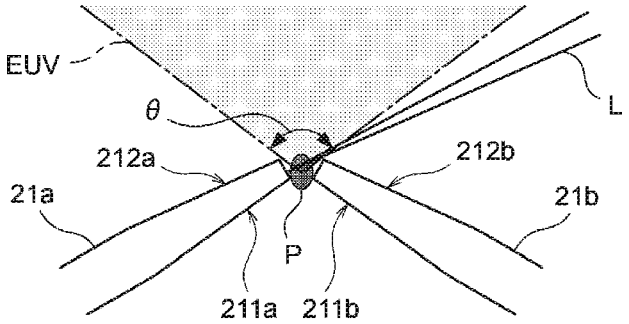
FIG. 8 illustrates a laser beam that comes from an EUV radiation side.

In the above-described embodiment, the incoming side of the laser beam L is opposite to the radiation side of the EUV light across the discharge electrodes 21*a* and 21*b*. It should be noted, however, that as illustrated in FIG. 8, for example, the radiation side of the EUV light and the incoming side of the laser beam L may be on the same side. In this case, the inclined surfaces may be formed at the ends of the discharge electrodes 21*a* and 21*b*, respectively. With such configuration, the angle θ of EUV radiation can be increased, as described above, by the inclined surfaces 212*a* and 212*b* on the radiation side, and the extraction efficiency of the EUV light can be improved.

The high-temperature-plasma source materials (tin) 22*a* and 22*b* can adhere to the ends of the electrodes efficiently by the inclined surfaces 211*a* and 211*b* on the side opposite to the radiation side of the EUV light (the incoming side of the laser beam L). When the discharge electrodes 21*a* and 21*b* rotate, the centrifugal force acts also on the tin 22*a* and 22*b* adhering to the surfaces of the discharge electrodes 21*a* and 21*b*, and the tin 22*a* and 22*b* tends to move toward the peripheries of the discharge electrodes 21*a* and 21*b*. At this point in time, if the inclined surfaces are formed at the peripheries, the tin 22*a* and 22*b* flows onto the end faces of the electrodes more easily. Therefore, it is possible to cause the tin 22*a* and 22*b* to adhere appropriately to regions necessary for producing the plasma P.

Application Examples

In the above-described embodiment, a laser is used as an energy beam with which the high-temperature-plasma source material is irradiated. It should be noted, however, that an ion beam, an electron beam, and the like can be used in place of the laser.

In the foregoing embodiment, the EUV light source device is used as a light source for exposing semiconductor. It should be noted, however, that this is not a limiting example. For example, the EUV light source device may be used as a light source for an inspection device of an exposure mask.

When the above-described EUV light source device functions as a VUV light source device for extracting VUV (vacuum ultraviolet light), this VUV light source device can be used as a light source for reforming the surface of a substrate, a light source for producing ozone, or a light source for bonding substrates.

When the above-described EUV light source device functions as an X-ray generating device for extracting X-rays, this X-ray generating device can be used for applications such as chest X-ray photography, dental X-ray photography, and CT (Computer Tomogram) in the medical fields. In addition, this X-ray generating device can be used for applications such as non-destructive testing or non-destructive tomography testing for observing the interior of a substance in a structural body or a welded portion in the industrial fields. Furthermore, this X-ray generating device can be used for applications such as an X-ray analysis for analyzing the crystal structure of a substance or X-ray spectroscopy (fluorescence X-ray analysis) for analyzing a constituting element of a substance in the research fields.

Although specific embodiments have been described above, these embodiments are merely illustrative in nature and are not intended to limit the scope of the present invention. The device and the methods described in the present specification can be implemented in embodiments aside from those described above. In addition, omissions, substitutions, and modifications can be made, as appropriate, to the embodiments described above without departing from the scope of the present invention. An embodiment with such omissions, substitutions, and modifications is encompassed by what is described in the claims and any equivalent thereof and falls within the technical scope of the present invention.

REFERENCE NUMERALS AND SYMBOLS

11 Chamber
12 EUV collector mirror
13 Foil trap
21*a*, 21*b* Discharge electrode
22*a*, 22*b* High-temperature-plasma source material
23*a*, 23*b* Container
24*a*, 24*b* Motor
27 Pulsed power supply unit
28 Laser source
100 Extreme ultraviolet light source device (EUV light source device)
211*a*, 211*b* Inclined surface (incoming side)
212*a*, 212*b* Inclined surface (radiation side)

The invention claimed is:

1. A pair of disc-shaped discharge electrodes for use in a light source device, one electrode in said pair of discharge electrodes having first and second flat circular surfaces, which are parallel to each other, and a first outer peripheral surface, which connects the first flat circular surface to the second flat circular surface, another one electrode in said pair of discharge electrodes having third and fourth flat circular surfaces, which are parallel to each other, and a second outer peripheral surface, which connects the third flat circular surface to the fourth flat circular surface, said pair of discharge electrodes disposed such that the first and second outer peripheral surfaces of said pair of discharge electrodes oppose each other with a predetermined space left therebetween, the light source device including said pair of discharge electrodes, a pulsed power supply unit that supplies pulsed power across the discharge electrodes, a source material supply unit that supplies onto the discharge electrodes a source material to radiate light, and an energy beam irradiation unit that irradiates the source material on one of the first and second outer peripheral surfaces of the discharge electrodes with an energy beam to vaporize the source material, at least one of the discharge electrodes having a first inclined surface formed on at least one flat circular surface thereof, with the first and second outer peripheral surfaces being left, the first inclined surface being inclined such that a thickness of the discharge electrode decreases in a radially outward direction of the discharge electrode.

2. The pair of discharge electrodes according to claim 1, wherein the first inclined surface having an angle of inclination corresponding to a take-off angle of the light from the discharge electrodes is provided on the flat circular surface located on a side toward which the light is extracted from the discharge electrodes.

3. The pair of discharge electrodes according to claim 2, wherein the first inclined surface is provided on one flat circular surface among the first to fourth flat circular surfaces, and a second inclined surface having an angle of inclination corresponding to an angle of incidence of the energy beam on said one of the first and second outer peripheral surfaces of the discharge electrodes is provided on another flat circular surface among the first to fourth flat circular surfaces located on a side where a radiation source of the energy beam is installed.

4. The pair of discharge electrodes according to claim 2, wherein said at least one of the discharge electrodes has the first inclined surface provided on one of the flat circular surfaces of said at least one of the discharge electrodes and a second inclined surface provided on an opposite flat circular surface of the same discharge electrode, the angle of inclination of the first inclined surface is set to an angle different from the angle of inclination of the second inclined surface.

5. The pair of discharge electrodes according to claim 2, wherein said one of the discharge electrodes has the first inclined surface provided on one of the flat circular surfaces of said one of the discharge electrodes, said another one of the discharge electrodes has a third inclined surface provided on one of the flat circular surfaces of said another one of the discharge electrodes, and the angle of inclination of the first inclined surface is set to an angle different from the angle of inclination of the third inclined surface.

6. The pair of discharge electrodes according to claim 1, wherein the first inclined surface having an angle of inclination corresponding to an angle of incidence of the energy beam on said one of the first and second outer peripheral surfaces of the discharge electrodes is provided on the flat circular surface located on a side where a radiation source of the energy beam is installed.

7. The pair of discharge electrodes according to claim 6, wherein said at least one of the discharge electrodes has the first inclined surface provided on one of the flat circular surfaces of said at least one of the discharge electrodes and a second inclined surface provided on an opposite flat circular surface of the same discharge electrode, the angle of inclination of the first inclined surface is set to an angle different from the angle of inclination of the second inclined surface.

8. The pair of discharge electrodes according to claim 6, wherein said one of the discharge electrodes has the first inclined surface provided on one of the flat circular surfaces of said one of the discharge electrodes, said another one of the discharge electrodes has a third inclined surface provided on one of the flat circular surfaces of said another one of the discharge electrodes, and the angle of inclination of the first inclined surface is set to an angle different from the angle of inclination of the third inclined surface.

9. The pair of discharge electrodes according to claim 1, wherein said at least one of the discharge electrodes has the first inclined surface provided on one of the flat circular surfaces of said at least one of the discharge electrodes and a second inclined surface provided on an opposite flat circular surface of the same discharge electrode, the angle of inclination of the first inclined surface is set to an angle different from the angle of inclination of the second inclined surface.

10. The pair of discharge electrodes according to claim 9, wherein said one of the discharge electrodes has the first inclined surface provided on one of the flat circular surfaces of said one of the discharge electrodes, said another one of the discharge electrodes has a third inclined surface provided on one of the flat circular surfaces of said another one of the discharge electrodes, and the angle of inclination of the first inclined surface is set to an angle different from the angle of inclination of the third inclined surface.

11. The pair of discharge electrodes according to claim 1, wherein said one of the discharge electrodes has the first inclined surface provided on one of the flat circular surfaces of said one of the discharge electrodes, said another one of the discharge electrodes has a third inclined surface provided on one of the flat circular surfaces of said another one of the discharge electrodes, the angle of inclination of the first inclined surface is set to an angle different from the angle of inclination of the third inclined surface.

12. The pair of discharge electrodes according to claim 1, wherein said one of the discharge electrodes has the first inclined surface provided on the first flat circular surface and a second inclined surface provided on the second flat circular surface, and said another one of the discharge electrodes has a third inclined surface on the third flat circular surface and a fourth inclined surface on the fourth circular surface.

13. The pair of discharge electrodes according to claim 12, wherein an angle of inclination of the first inclined surface is equal to an angle of inclination of the second inclined surface, and an angle of inclination of the third inclined surface is equal to an angle of inclination of the fourth inclined surface.

14. The pair of discharge electrodes according to claim 12, wherein an angle of inclination of the first inclined surface is different from an angle of inclination of the second inclined surface, and an angle of inclination of the third inclined surface is different from an angle of inclination of the fourth inclined surface.

15. The pair of discharge electrodes according to claim 12, wherein an angle of inclination of the first inclined surface is equal to an angle of inclination of the third inclined surface, and an angle of inclination of the second inclined surface is equal to an angle of inclination of the fourth inclined surface.

16. The pair of discharge electrodes according to claim 15, wherein the angle of inclination of the first inclined surface is different from the angle of inclination of the second inclined surface, and the angle of inclination of the third inclined surface is different from the angle of inclination of the fourth inclined surface.

17. A light source device comprising:

a pair of discharge electrodes, one electrode in said pair of discharge electrodes having first and second flat circular surfaces, which are parallel to each other, and a first outer peripheral surface, which connects the first flat circular surface to the second flat circular surface, another one electrode in said pair of discharge electrodes having third and fourth flat circular surfaces, which are parallel to each other, and a second outer peripheral surface, which connects the third flat circular surface to the fourth flat circular surface, said pair of discharge electrodes disposed such that the first and second outer peripheral surfaces of said pair of discharge electrodes oppose each other with a predetermined space left therebetween;

a pulsed power supply unit that supplies pulsed power across the discharge electrodes;

a source material supply unit that supplies onto the discharge electrodes a source material to radiate light; and an energy beam irradiation unit that irradiates the source material on one of the first and second outer peripheral surfaces of the discharge electrodes with an energy beam to vaporize the source material, at least one of the discharge electrodes having a first inclined surface formed on at least one flat circular surface thereof, with the first and second outer peripheral surfaces being left, the first inclined surface being inclined such that a thickness of the discharge electrode decreases in a radially outward direction of the discharge electrode, wherein the light emitted by the light source device is one of extreme ultraviolet light, an X-ray or vacuum ultraviolet light.

18. The light source device according to claim 17, wherein the light is extreme ultraviolet light.

19. The light source device according to claim 17, wherein the light is an X-ray.

20. The light source device according to claim 17, wherein the light is vacuum ultraviolet light.

* * * * *